United States Patent [19]

Sons et al.

[11] 4,251,005

[45] Feb. 17, 1981

[54] TANK

[75] Inventors: Mack D. Sons; William F. Schlegel, both of Albuquerque, New Mex.

[73] Assignee: Magnum Industries, Inc., Albuquerque, New Mex.

[21] Appl. No.: 820,457

[22] Filed: Aug. 1, 1977

[51] Int. Cl.[3] ..... B65D 25/04

[52] U.S. Cl. ..... 220/22; 105/360; 280/5 C; 280/5 F

[58] Field of Search ..... 220/22; 280/5 C, 5 F; 105/360

[56] References Cited

U.S. PATENT DOCUMENTS

| | | | |
|---|---|---|---|
| 1,392,892 | 10/1921 | Imber | 220/22 |
| 1,394,742 | 10/1921 | Kramer | 220/22 |
| 1,616,008 | 2/1927 | Stout | 220/22 |
| 1,909,734 | 5/1933 | Thwaits | 220/22 |
| 2,011,161 | 8/1935 | Robinson | 280/5 C |
| 3,131,949 | 5/1964 | Black | 220/22 |
| 3,192,877 | 7/1965 | Wright | 105/360 |
| 3,341,215 | 9/1967 | Spector | 280/5 C |

*Primary Examiner*—George E. Lowrance
*Attorney, Agent, or Firm*—Robert W. Harris

[57] ABSTRACT

A tank for transporting liquids, having a baffle system for control of liquid surges produced by acceleration of the tank in transit. Large cylindrical hollow baffles, parallel to the longitudinal tank axis, are mounted between transverse support partitions, the entire assembly being rigidly attached to the walls of the tank vessel. Small relief holes in the cylindrical baffles allow the liquid level in the baffles to change as the tank is filled or drained. Transverse liquid surges are controlled by the cylindrical baffles, which prevent surging of the liquid contained within the baffles, while deflecting and dissipating wave motion and surges of liquid outside the baffles. Longitudinal surges are controlled by the transverse support partitions. The configuration of cylindrical baffles and transverse partitions serves to enhance the mechanical strength of the tank, while minimizing the portion of the interior volume occupied by baffle or partition material, in comparision with some other baffle configurations which are effective in controlling surging.

13 Claims, 6 Drawing Figures

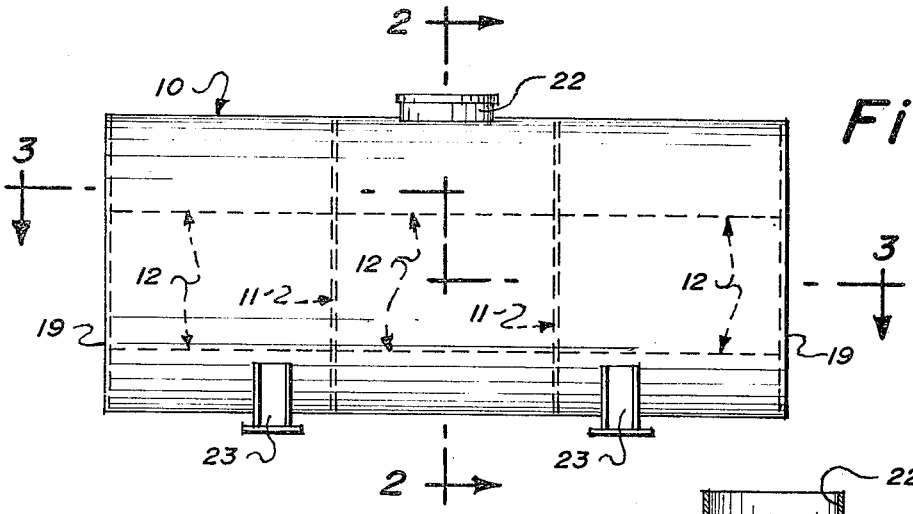
Fig. 1
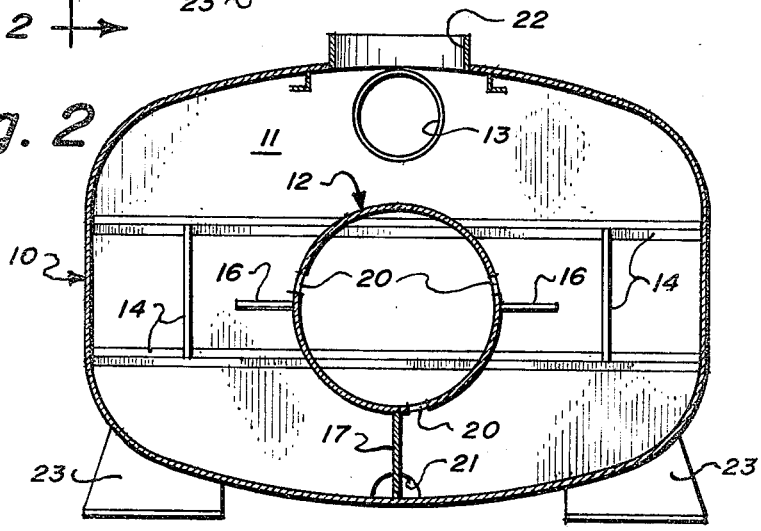
Fig. 2
Fig. 3
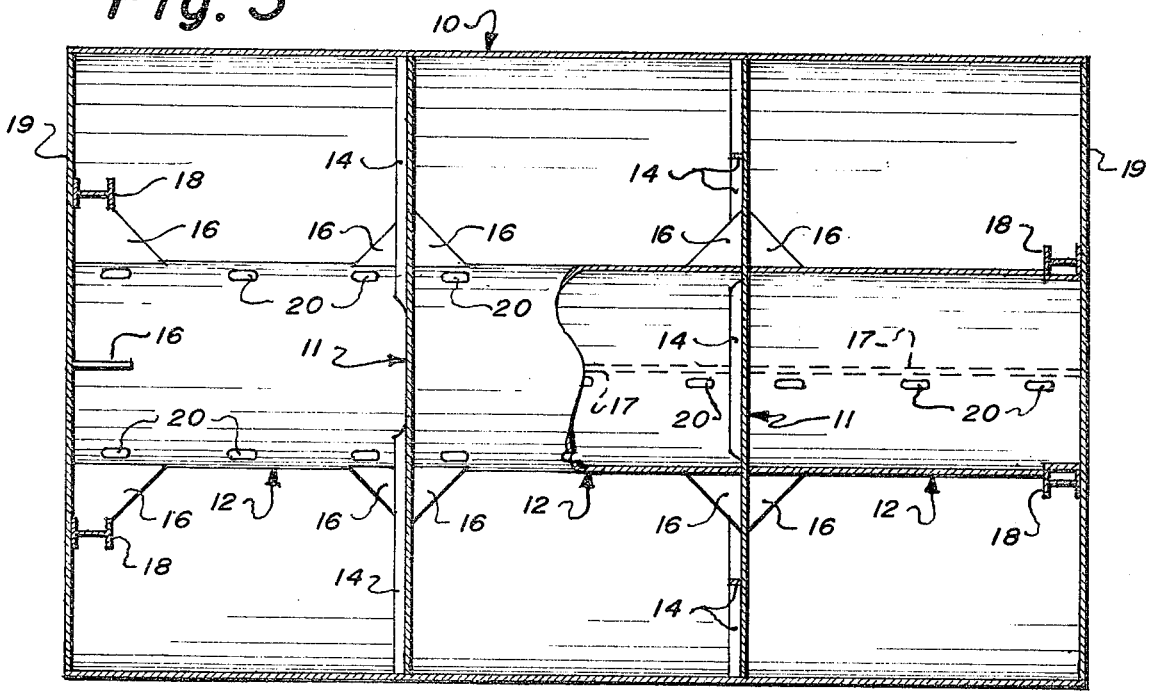

TANK

BACKGROUND OF THE INVENTION

1. Field of the Invention

The invention relates to tanks used for transporting liquids, and more particularly to an improved internal baffle structure used to minimize wave motion in a free liquid surface and surging of liquid resulting from accelerations imparted to the tank during transportation.

2. Description of the Prior Art

In the transportation of large volumes of liquids in tank trucks it is well known that internal baffles are necessary to control surging and wave motion of the free surface in the liquid cargo, particularly transverse surging resulting from centrifugal forces experienced on curves and during turning. Without adequate baffling the entire vehicle may become unstable and even overturn, particularly where the tank is between ¼ and ¾ full and the free surface is large.

Many conventional tank truck designs use a single flat vertical longitudinal baffle bisecting the tank along the longitudinal axis. Frequently it has been observed that such a baffle is subject to severe wear resulting from incessant pounding of liquid waves against its surface. Such baffles frequently become dislodged and must be repaired or replaced after a few months of use.

The present invention solves these problems through the use of large longitudinal cylindrical baffles mounted between flat transverse support partitions, the entire assembly being rigidly attached to the interior walls of the tank vessel. This configuration greatly reduces and dissipates liquid surging and wave motion, while offering enhanced mechanical strength for the tank and baffle assembly.

Although the patent of Wright (U.S. Pat. No. 3,192,877) describes railroad tank cars containing numerous transverse cylindrical baffles, the present invention differs markedly from Wright with regard to construction, purposes and manner of operation. The Wright patent teaches that its invention controls longitudinal surging by dividing the liquid into "numerous increments of relatively small volume" (See Column 8, line 8), while the present invention effectively controls transverse surging and wave motion with a single large longitudinal cylindrical baffle in each section of the tank.

Various tanks using flat baffles or compartment partition walls, including some partially curved partition walls, are disclosed in the patents of Kramer (U.S. Pat. No. 1,462,347), Moxey (U.S. Pat. No. 2,049,132), Dalglish (U.S. Pat. No. 2,723,862) (also involving compartments for dry goods), and French Pat. No. 1,016,701. However, no patent or combination of patents known to the applicants shows or suggests the invention claimed herein.

SUMMARY OF THE INVENTION

The present invention encompasses tanks for transporting liquids, having internal baffles and partitions for the principal purpose of improved control of liquid surging and wave motion resulting from accelerations imparted to the tank during transportation. The tank vessel is divided into a number of compartments by flat support partitions transverse to the principal longitudinal tank vessel axis. Within each compartment a large cylindrical baffle, rigidly attached to the support partitions, is fixed parallel to the longitudinal tank vessel axis. Relief holes in the walls of the cylindrical baffles allow a significant portion of the liquid cargo to enter or exit the cylindrical baffles when the tank vessel is filled or drained.

Transverse liquid surges and wave motion resulting from centrifugal acceleration experienced on curves and during turning are effectively minimized by the cylindrical baffles, in several ways. Surges of liquid outside the baffles are deflected in various directions by the curved cylindrical surface. Wave shock is effectively eliminated, in comparison with conventional flat longitudinal baffles, since waves do not impringe suddenly against a large flat surface. The significant portion of the liquid cargo contained within the cylindrical baffles is restrained from surging freely within the tank vessel as a whole.

Longitudinal liquid surging is controlled and minimized by the transverse support partitions which divide the tank vessel into compartments.

The configuration of longitudinal cylindrical baffles and transverse support partitions produces a tank structure of great mechanical strength, an additional purpose of the invention.

Another purpose or object of the invention is the provision of a tank which offers superior surge control and mechanical strength with a minimum of baffling material, so as to minimize costs of construction and maintenance, and offer maximum effective liquid storage volume for a given sized tank.

BRIEF DESCRIPTION OF THE DRAWING

FIG. 1 is a side elevational view of the tank.

FIG. 2 is a sectional view taken along the line 2—2 in FIG. 1.

FIG. 3 is a plan view taken along the line 3—3 in FIG. 1.

DESCRIPTION OF THE PREFERRED EMBODIMENT

Figure 4:
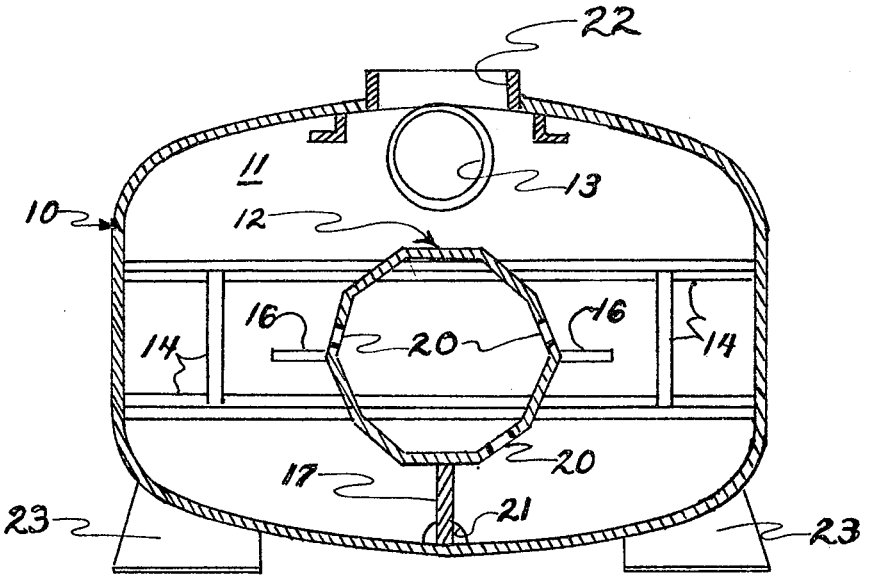
FIG. 4 is a sectional view in the direction of the view shown in FIG. 2, of an embodiment of the invention having baffles of polygonal cross section.

Referring now to FIGS. 1, 2 and 3 of the drawings, wherein like reference numbers designate like or corresponding parts, the tank vessel 10 contains one or more support partitions 11 welded to the inner walls of the tank vessel 10, and two or more hollow cylindrical baffles 12, welded to the support partitions 11, the axes of the cylindrical baffles 12 being parallel to the longitudinal axis of the tank vessel 10. The support partitions 11 are perpendicular to the longitudinal axis of the tank vessel 10.

The support partitions 11 each have a manhole 13 to allow workmen to travel between the compartments created by the support partitions 11, for cleaning, maintenance and repair.

In order to enhance the mechanical strength of the entire assembly the support partitions 11 have welded to their surfaces stiffeners 14, in the form of angle iron, metallic rods, or similar material adapted to stiffening the support partitions 11. Gussets 16 are welded to the support partitions 11 and cylindrical baffles 12 at their point of connection, for additional mechanical strength.

Additional mechanical support for the structure of support partitions 11 and cylindrical baffles 12 is provided by baffle undersupports 17. The baffle undersupports 17 are flat rectangular plates, each with length axis directly below and parallel to the longitudinal axis of the tank vessel 10, and width axis vertical. Each baffle undersupport 17 is welded to the bottom of a cylindrical baffle 12, to the inside bottom wall of the tank vessel 10, and to the adjacent support partitions 11.

End supports 18, in the form of vertical I beams, welded to the interior end walls 19 of the tank vessel 10 and the adjacent cylindrical baffles 12, secure the endmost cylindrical baffles 12 to the interior end walls 19 of the tank vessel 10, preventing transverse motion of the cylindrical baffles 12 at the juncture with the interior end walls of the tank vessel 10.

In the preferred embodiment the support partitions 11, baffle undersupports 17, and end supports 18 together constitute the baffle support means for support of the cylindrical baffles 12, which means serve to hold the cylindrical baffles 12 fixed in relation to the tank vessel 10.

The hollow cylindrical baffles 12 are of such size that a significant portion of the interior volume of the tank vessel 10 is within the cylindrical baffles 12.

The cylindrical baffles 12 each contain a plurality of relief holes 20, which are sufficient in number and aperture to allow the level of liquid cargo to change gradually throughout the tank vessel 10 and the interiors of the cylindrical baffles 12, during tank filling or drainage operations. The total aperture area of the relief holes 20 is, however, small in relation to the total surface area of each cylindrical baffle 12, so that the liquid cargo contained within each cylindrical baffle 12 is effectively restrained from surging freely throughout the volume of the tank vessel 10.

In order that the liquid level may change uniformly in the various compartments of the tank vessel 10 during filling and drainage of the tank vessel 10, each support partition 11 has a flow port 21 at the bottom thereof, to allow flow of liquid between the compartments formed by the support partitions 11.

The tank vessel 10 has a filling port 22, for filling the tank vessel 10. Tank anchorsupports 23 provide means for anchoring the tank vessel 10 to the bed of a truck, or other manner of conveyance.

The tank vessel 10 may be fabricated using conventional procedures for rolling of sheet steel, and conventional welding procedures. The support partitions 11, cylindrical baffles 12 and associated support elements are installed and welded within the tank vessel 10 before the tank vessel 10 is closed by rolling its sheet steel walls across the top of the tank vessel 10. The tank vessel 10 is sealed on top, near the filling port 22, by welding along a seam parallel to the longitudinal axis of the tank vessel 10.

Although details of the theory of operation of the invention are not fully understood, it is believed that the invention controls and inhibits surging and wave motion of the liquid cargo in the following manner:

First, the significant portion of the liquid cargo contained within the cylindrical baffles 12 is effectively prevented from surging freely within the tank vessel 10, because of the limited apertures of the relief holes 20. Moreover, streams of surging liquid which do exit the cylindrical baffles 12 through the relief holes 20 tend to interfere with the motion of liquid outside the cylindrical baffles 12, and thereby tend to dissipate the collective motion of the surging liquid. Such an interference effect would be comparatively insignificant or nonexistent in the case of a perforated flat baffle, since streams of surging liquid passing through apertures in the flat baffle will thereafter be moving parallel to the surge of liquid on the far side of the baffle. But in the operation of applicants' invention it will be understood that when liquid outside the cylindrical baffle 12 impinges upon the curved surface of the cylindrical baffle 12 a portion of the liquid tends to flow around the cylindrical baffle 12, with a significant component of velocity parallel to the surface of the cylindrical baffle 12. Since streams of liquid exiting the cylindrical baffle 12 through the relief holes 20 are necessarily moving perpendicular to the surface of the cylindrical baffle 12, a significant velocity-conflict interference effect is produced, which would not be produced by a flat perforated baffle.

Second, the liquid surging outside the cylindrical baffles 12 is deflected in various directions by the curved outer surfaces of the cylindrical baffles 12, so that collective motion of the liquid is dissipated.

Third, waves generated in the surface of the liquid outside the cylindrical baffles 12 impinge gradually upon the curved surfaces of the cylindrical baffles 12, rather than suddenly impinging upon a flat vertical wall, as in the case of collision with a conventional flat baffle, or with an interior wall of the tank vessel 10. The mechanical shocks associated with transverse wave motion are thus greatly diminished.

Fourth, longitudinal surging of liquid is controlled and inhibited by the support partitions 11, which divide the tank vessel 10 into compartments and thereby prevent the liquid cargo from surging freely throughout the length of the tank vessel 10.

Fifth, longitudinal surging of liquid is also inhibited in that liquid contained within each cylindrical baffle 12 will be driven out of the relief holes 20 adjacent to the support partition 11 which damps the longitudinal surge within the cylindrical baffle 12, by the sudden increase in liquid pressure near the face of the support partition 11. Streams of liquid thus exiting the cylindrical baffle 12 through the relief holes 20 will tend to interfere with longitudinal motion of liquid outside the cylindrical baffles 12.

It should also be appreciated that wave oscillations of liquid within the cylindrical baffles 12 (occurring when the liquid level is such that the cylindrical baffles 12 are only partially full) will generally be of a different natural frequency than those of the liquid outside the cylindrical baffles 12. The natural frequency of oscillation of a liquid in a partially filled container will depend upon the surface wave velocity of the liquid and the width of the container. Thus the vibrations and shocks transmitted to the tank vessel 10 and its conveyance vehicle by surging of the portions of the liquid within and outside of the cylindrical baffles 12 will generally be out of phase, rather than complementing and adding to one another. The present invention thus reduces the maximum amplitude of such shocks not only by inhibiting collective liquid motion, but by causing different portions of the liquid cargo to oscillate at different frequencies.

A number of complete tanks have been recently fabricated using the present invention, using steel as the material of construction, with a single cylindrical baffle 12 between each pair of support partitions 11. Field testing of some of these tanks over a period of about three months has indicated that the present invention offers superior control of liquid surging, in comparison to tank trucks constructed using the prior art. In view of the manner of operation of the invention it is obvious that the tank vessel 10 or any internal component parts may also be fabricated from any other solid material of sufficient mechanical strength, whether composed of another metal, of plastic, wood, or any other solid material of sufficient mechanical strength.

Although cylindrical baffles 12 have been used in the tanks fabricated using the present invention, the manner of operation of the invention is such that one could instead use baffles 12 having many noncylindrical shapes. It is only necessary that the baffle possess an outer surface which (1) will deflect surging liquid in numerous different directions; and (2) has such a configuration that an advancing liquid wave encounters the baffle surface gradually. To understand the necessary properties of the baffle surface it is helpful to consider the transverse cross section of the baffle 12, taken in a direction perpendicular to the axis of the baffle 12, as shown in FIG. 2.

Although each transverse cross section of a cylindrical baffle 12 is a circle of the same radius, it is apparent that one may obtain a baffle surface having the required properties by utilizing a baffle 12 having an exterior wall which is a surface of revolution, in which different transverse cross sections are circles of different radii.

More generally, it will be recognized by persons skilled in the art that the invention is not confined to the use of baffles 12 the exterior walls of which have circular transverse cross sections. One may effectively utilize a baffle 12 the exterior wall of which has an elliptical transverse cross section, and in which the lengths of the major and minor axes of the ellipse vary along the length of the baffle 12.

Indeed, one may utilize any baffle having an outer wall which in transverse cross section is a smooth continuous curve, convex outward along each horizontal radius of the transverse cross section. For any such cross section, advancing waves in the exterior liquid encounter the baffle surface gradually, and surges of liquid are deflected in numerous different directions by the baffle surface.

It will also be recognized by those skilled in the art that one may effectively utilize a baffle 12 the exterior wall of which has a transverse cross section which is a polygon of more than four sides, as shown in FIG. 4, provided the lengths of the sides of the polygon are small in relation to the mean radius of the polygon, and provided the polygon is "convex" outward along each horizontal radius of the transverse cross section—i.e., the interior angles formed by the sides of the polygon must be less than 180° in the portion of the polygon adjacent to each horizontal radius of the transverse cross section.

Figure 5:
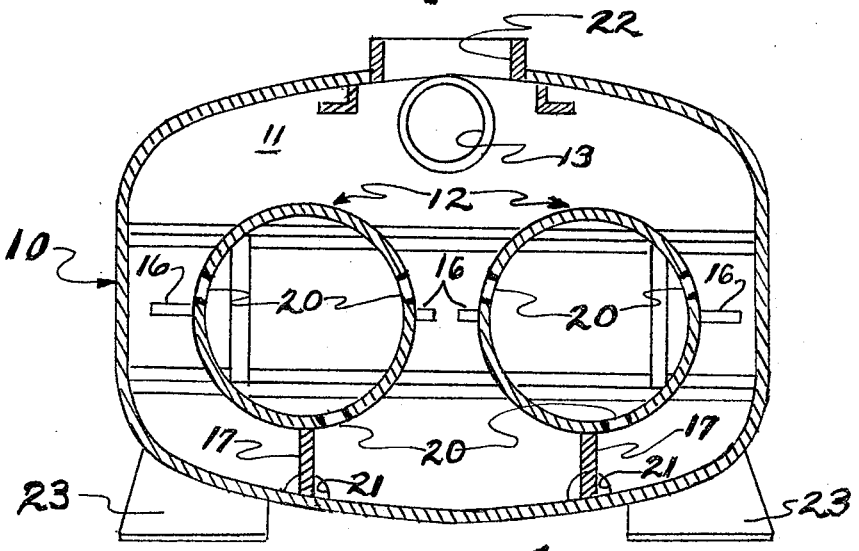
FIG. 5 is a sectional view in the direction of the view shown in FIG. 2, of an embodiment of the invention having a plurality of baffles in a single tank compartment.
Figure 6:
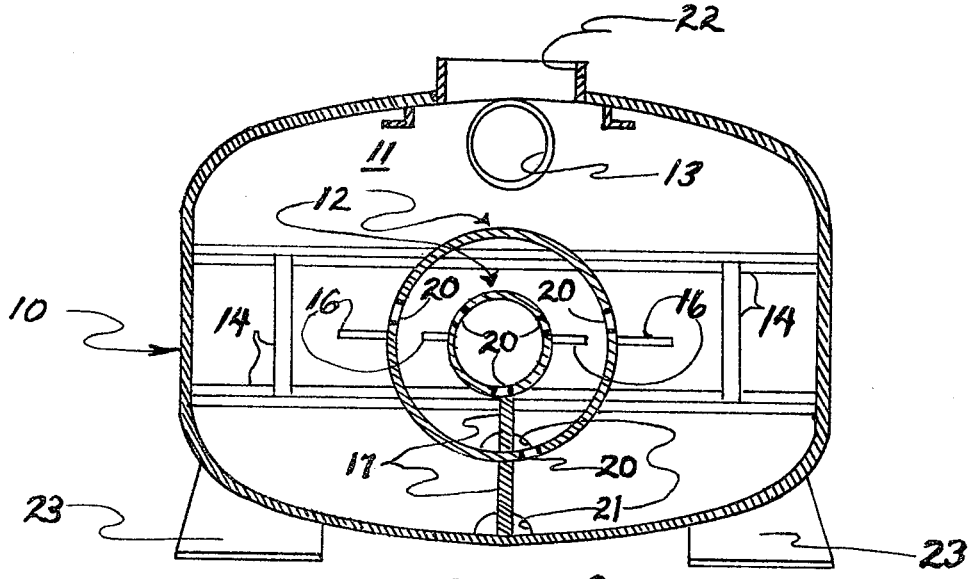
FIG. 6 is a sectional view in the direction of the view shown in FIG. 2, of an embodiment of the invention having a plurality of coaxial baffles in each tank compartment.

Although the tanks which have been fabricated using the present invention involve a single cylindrical baffle 12 between adjacent support partitions 11, it is apparent from the manner of operation of the invention that a plurality of baffles 12 may be utilized in each compartment formed by adjacent support partitions 11. Thus, in tanks of larger size a plurality of baffles 12 may be installed in each compartment, and could be positioned parallel to one another and to the axis of the tank vessel 10. An embodiment having a plurality of baffles 12 in each compartment is illustrated in FIG. 5. It is also apparent that for larger tanks one could instead utilize a plurality of coaxial baffles 12 of varying radii, within each compartment formed by adjacent support partitions 11. This coaxial configuration is illustrated in FIG. 6.

As pointed out above the beneficial effects of applicants' invention result in part from the multidirectional deflection of surging liquid by the curved outer surfaces of the cylindrical baffles 12. A plurality of cylindrical baffles 12 located between adjacent support partitions 11 will produce significant interference between the motions of portions of liquid deflected from the outer surfaces of the various cylindrical baffles 12. Thus a plurality of cylindrical baffles 12 between adjacent support partitions 11 would, through such interference effects, reduce and dissipate collective motion of the liquid by additional effects beyond those produced by a single cylindrical baffle 12.

It has also been pointed out above that the liquid located within a single cylindrical baffle 12 would, in general, oscillate at a different frequency from that of the liquid outside the cylindrical baffle 12, and that this frequency difference tends to reduce the maximum amplitude of mechanical shocks produced by the surging liquid. Applicants submit that through use of a plurality of coaxial cylindrical baffles 12 of varying radii one may produce any desired number of different oscillation frequencies, and may thereby greatly enhance the frequency incoherency effect beyond that obtainable with a single cylindrical baffle 12 between adjacent support partitions 11.

For tanks of smaller length it may be unnecessary to utilize support partitions 11, in which case one or more baffles 12 may be attached directly to each interior end wall of the tank vessel 10.

Those skilled in the art will also recognize that for applications in which longitudinal surging of the liquid cargo is not a significant problem, it may be unnecessary to utilize the support partitions 11 even for long tanks. In this event the baffles 12 may be adequately supported by rods or other support members welded to the interior walls of the tank vessel 10 and to the outer walls of the baffles 12, and by endsupports 18 of the type described previously.

Although welding has been used to attach parts of the apparatus in the tanks which have been fabricated, it will of course be recognized that parts may be attached by any process or device capable of securely affixing the parts together in the configurations described above.

Although the preferred embodiment utilizes baffles 12 which are parallel to the longitudinal axis of the tank vessel 10, and support partitions 11 which are perpendicular to said axis, those skilled in the art will of course appreciate that the manner of operation of the invention does not require that said baffles 12 be precisely parallel to said axis, nor that said support partitions 11 be precisely perpendicular to said axis. The operation of the invention will not be significantly affected if these orientations are essentially, although not precisely observed.

Those skilled in the art will appreciate that the invention may be employed in conveyances and in configurations other than those specifically disclosed herein, and that various changes and modifications other than those indicated above can be made in the invention without departing from the spirit and scope thereof. The essential characteristics of the invention are defined in the appended claims.

We claim:

1. A tank for transporting liquids, comprising:
(a) a tank vessel for holding the liquid, having a principal longitudinal axis;
(b) baffle support means, rigidly attached to the interior walls of said tank vessel, for holding at least one baffle in fixed position within said tank vessel;
(c) at least one baffle, rigidly attached to said baffle support means, with the principal axis of said baffle being essentially parallel to the longitudinal axis of said tank vessel, said baffle being hollow and of such size that the total interior volume of said baffle or baffles is a significant portion of the interior volume of said tank vessel, said baffle having a plurality of holes in its surface, of total aperture area small in relation to the surface area of said baffle, said baffle having an outer wall each transverse cross section of which is a smooth continuous curve, convex outward along each horizontal radius of the transverse cross section of said baffle.

2. The tank of claim 1, wherein said baffle has an outer wall each transverse cross section of which is an ellipse.

3. The tank of claim 1, wherein said baffle has an outer wall defined by a surface of revolution, each transverse cross section of said baffle being a circle.

4. The tank of claim 3, wherein said baffle has an outer wall which is a cylinder.

5. A tank for transporting liquids, comprising:
(a) a tank vessel for holding the liquid, having a principal longitudinal axis;
(b) baffle support means, rigidly attached to the interior walls of said tank vessel, for holding at least one baffle in fixed position within said tank vessel;
(c) at least one baffle, rigidly attached to said baffle support means, with the principal axis of said baffle being essentially parallel to the longitudinal axis of said tank vessel, said baffle being hollow and of such size that the total interior volume of said baffle or baffles is a significant portion of the interior volume of said tank vessel, said baffle having a plurality of holes in its surface, of total aperture area small in relation to the surface area of said baffle, said baffle having an outer wall each transverse cross section of which is a polygon of more than four sides, having sides which are small in relation to the means radius of the polygon, and having interior angles which are less than 180° in the portion of the polygon adjacent to each horizontal radius of the transverse cross section of said baffle.

6. The tank of claim 1, wherein said baffle support means comprises: at least one support partition, essentially perpendicular to the longitudinal axis of said tank vessel, rigidly attached to the interior wall of said tank vessel and to the ends of adjacent baffles; end support means, rigidly attached to the interior end walls of said tank vessel and to the ends of adjacent baffles, for securing adjacent baffles to the interior end walls of said tank; baffle undersupports, rigidly attached to the interior bottom wall of said tank vessel and to the bottom exterior wall of each baffle.

7. The tank of claim 6, wherein at least one baffle is positioned between each pair of adjacent support partitions, and between each interior end wall of said tank vessel and the adjacent support partition.

8. The tank of claim 1, wherein said baffle support means comprises end support means, each of which is rigidly attached to the interior end walls of said tank vessel and to one end of each baffle contained within said tank vessel, for securing said baffles to the interior end walls of said tank vessel.

9. The tank of claim 1, wherein said baffle support means comprises a plurality of support members rigidly attached to the interior walls of said tank vessel and to the exterior walls of baffles contained within said tank vessel.

10. The tank of claim 1, wherein said tank vessel has a filling port for filling said tank vessel with liquid, and anchor-support means for anchoring said tank vessel to a means of conveyance.

11. The tank of claim 6, wherein each said support partition has at least one manhole for ingress and egress between adjacent compartments of said tank vessel formed by said support partition, stiffeners attached to the surface of said support partition, and at least one flow port at the bottom of said support partition, for flow of liquid between adjacent compartments of said tank vessel formed by said support partition.

12. The tank of claim 7, wherein a plurality of parallel baffles are located between each pair of adjacent support partitions, and between each interior end wall of said tank vessel and the adjacent support partition.

13. The tank of claim 7, wherein a plurality of coaxial baffles of different radii are located between each pair of adjacent support partitions, and between each interior end wall of said tank vessel and the adjacent support partition.

* * * * *